United States Patent [19]

Niemelä

[11] Patent Number: 4,693,023

[45] Date of Patent: Sep. 15, 1987

[54] SNOW SHAPING MEANS

[76] Inventor: Tapio Niemelä, Linnatie 10 D 5, 99100 Kittilä, Finland

[21] Appl. No.: 843,787

[22] Filed: Mar. 25, 1986

[30] Foreign Application Priority Data

Mar. 27, 1985 [FI] Finland ..... 851223

[51] Int. Cl.[4] ..... E01H 4/00

[52] U.S. Cl. ..... 37/224; 172/545; 172/535; 172/539

[58] Field of Search ..... 37/220, 222–224; 172/175–177, 185, 149, 518, 528–529, 535–536, 538–541, 544–545, 546, 550, 554

[56] References Cited

U.S. PATENT DOCUMENTS

| | | | |
|---|---|---|---|
| 440,015 | 11/1890 | Clark | 172/539 |
| 827,587 | 7/1906 | Warner | 172/538 |
| 955,590 | 4/1910 | Grimes | 37/224 |
| 2,538,167 | 1/1951 | Schmeiser | 172/545 |
| 3,071,050 | 1/1963 | Shatto | 172/534 X |
| 4,056,328 | 11/1977 | Maxey | 37/224 |
| 4,334,799 | 6/1982 | Rautenbach | 172/545 |
| 4,437,245 | 3/1984 | Niemela | 37/224 |

*Primary Examiner*—E. H. Eickholt

[57] ABSTRACT

A snow shaping means intended to be towed e.g. behind a vehicle and consisting of a cylindrical snow compacting means mounted in a frame and having track shaping elements on its periphery. Now that the so-called diagonal style has been introduced in skiing, track grooves as well as smooth spots are needed on a ski trail. As taught by the invention, the track shaping elements consist of parts disposed loosely on the periphery of the cylindrical drum and movable between an upper position and a lower position, and which in their lower position shape the track grooves.

3 Claims, 1 Drawing Figure

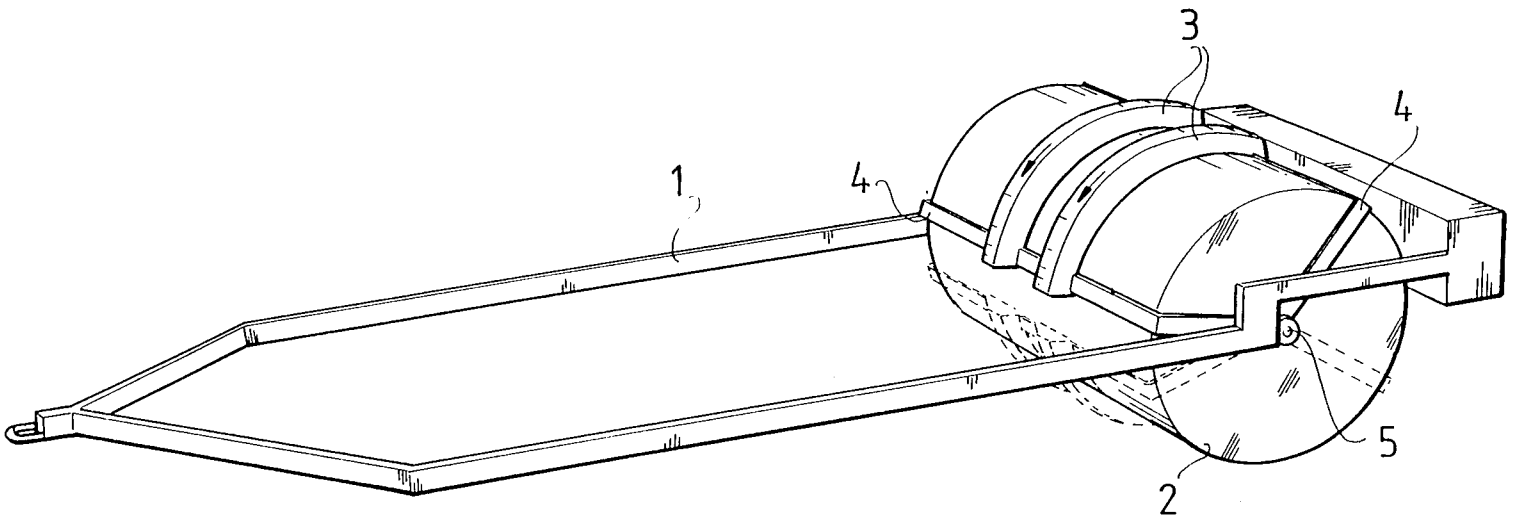
4
5
3
2
4
1

SNOW SHAPING MEANS

The present invention concerns a snow shaping means intended to be towed e.g. behind a vehicle and consisting of a cylindrical snow compacting means carrying ski track shaping elements on its circumference and mounted in a frame.

A snow shaping means of this type has been disclosed e.g. in the Finnish patent application No. 813868 and its corresponding U.S. Pat. No. 4,437,245. Since in skiing the so-called diagonal style has been introduced, it is now necessary also to make tracks consistent therewith, implying that they must be composed both of track grooves and of even spots. The object of the present invention is to provide a new type of snow shaping means by which it is possible to produce ski trails of the kind described. The snow shaping means of the invention is characterized in that the track shaping elements consist of parts which are loose on the periphery of a cylindrical drum and movable between an upper position and a lower position and which in their lower position shape the track grooves. It is possible with the aid of the invention to produce both track grooves, by keeping the snow shaping elements in the lower position, and smooth areas for the diagonal skiing style, this latter being done by moving the snow shaping elements further into their upper position, whereby the drum will leave a smooth trail. It goes without saying that to the snow shaping means can be fitted various means breaking up the hard crust, as well as drags, as has been disclosed for instance in the patent application cited above.

An advantageous embodiment of the invention is characterized in that the track shaping elements are over intermediary members, such as bar irons, rotatably carried on the same axle as the drum. Therefore the track shaping elements are shiftable with ease between their upper and lower position, this being accomplished by allowing them to rotate along with the drum, between the upper and lower position. The functions and securing in position of the track shaping elements can be arranged to operate with the aid of wire and lever means known in themselves in the art so that this control can be managed from the vehicle while driving.

Another embodiment of the invention is characterized in that the track shaping elements are exchangeable for different track configurations in which the depth and width of the track may vary. It is hereby possible with one snow shaping means to make tracks of different shapes with only minor changes of the means.

An advantageous embodiment of the invention is furthermore characterized in that one track shaping element has two or more consecutive track shapes.

The invention is described in the following with the aid of an example, referring to the attached drawing, which is a simplified presentation of the snow shaping means as viewed obliquely from above.

The snow shaping means consists of a rotating cylindrical snow compacting means 2 mounted in a frame 1 and having track shaping elements 3 on its periphery. The track shaping elements 3 consist of parts which are separate from the periphery of the drum 2 and can be moved between an upper position and a lower position, and which in their lower position shape the track grooves. The track shaping elements 3 are over bar irons 4 rotatably carried on the same axle as the drum 2. The lower position of the track shaping elements 3 has been indicated with dotted lines in the figure. When in their lower position, the track shaping elements impress the track grooves, and when they are in the upper position, the trail will be smooth by action of the drum 2. It goes without saying also that the track shaping elements are shifted into the upper position for crossing roads.

It is obvious to a person skilled in the art that the invention is not confined to the examples presented in the foregoing and that it may instead vary within the scope of the claims following below. For instance, it is possible to add to the snow shaping means various means which break up the hard crust, known in themselves in the art, with their rotating cutter units, as well as various snow levelling drags.

I claim:

1. A snow shaping means comprising a frame, a cylindrical drum having an axle rotatably mounted in the frame, whereby said drum can be towed by means of said frame e.g. behind a vehicle to compact snow, support members pivotably supported on said axle, track shaping elements carried by said support members so that they are movably disposed adjacent the periphery of the drum but separate therefrom, said track shaping elements being rotatable by said support members between an upper position in which said shaping elements are not in contact with the snow and a lower position in which said shaping elements contact the snow and shape track grooves therein.

2. Snow shaping means according to claim 1, wherein the track shaping elements are exchangeable for various track shapes in which the depth and width of the track may vary.

3. Snow shaping means according to claim 1, wherein there are two or more consecutive track shapes on one track shaping element.

* * * * *